US010920786B2

(12) United States Patent
Konzal et al.

(10) Patent No.: US 10,920,786 B2
(45) Date of Patent: Feb. 16, 2021

(54) FAN WHEEL DISC AND FAN WHEEL

(71) Applicant: ebm-papst Mulfingen GmbH & Co. KG, Mulfingen (DE)

(72) Inventors: Alexander Konzal, Igersheim (DE); Erhard Gruber, Satteldorf (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 95 days.

(21) Appl. No.: 16/220,075

(22) Filed: Dec. 14, 2018

(65) Prior Publication Data

US 2019/0120245 A1 Apr. 25, 2019

Related U.S. Application Data

(63) Continuation of application No. PCT/EP2017/065463, filed on Jun. 22, 2017.

(30) Foreign Application Priority Data

Jun. 28, 2016 (DE) ..... 10 2016 111 830

(51) Int. Cl.

| | |
|---|---|
| ***F04D 29/28*** | (2006.01) |
| ***F04D 29/02*** | (2006.01) |
| ***F04D 29/22*** | (2006.01) |
| ***F04D 29/30*** | (2006.01) |
| ***F04D 29/62*** | (2006.01) |

(52) U.S. Cl.

CPC ..... *F04D 29/282* (2013.01); *F04D 29/023* (2013.01); *F04D 29/2222* (2013.01); *F04D 29/281* (2013.01); *F04D 29/30* (2013.01); *F04D 29/626* (2013.01)

(58) Field of Classification Search

None

See application file for complete search history.

(56) References Cited

U.S. PATENT DOCUMENTS 4,874,293 A * 10/1989 Gutzwiller ..... F04D 29/281 416/184
6,125,920 A * 10/2000 Herbert ..... F28F 1/40 165/122
6,156,090 A * 12/2000 Ishikawa ..... F04D 29/30 55/471

(Continued)

FOREIGN PATENT DOCUMENTS

DE 20 2011 052 411 U1 3/2013
DE 20 2015 105 729 U1 11/2015

(Continued)

OTHER PUBLICATIONS

International Search Report dated Sep. 26, 2017 in corresponding PCT/EP2017/065463.

*Primary Examiner* — Michael Lebentritt

(74) *Attorney, Agent, or Firm* — Hamess, Dickey & Pierce, P.L.C.

(57) ABSTRACT

A fan wheel disc has at least one region that extends in a curved manner, at least in some sections, from radially inside to radially outside. A blade attachment surface is formed at least in some sections. The blade attachment fixedly connects an axial end side of at least one fan wheel blade. The blade attachment surface extends, at least in some sections, within the curved region of the fan wheel disc within a two-dimensional connecting plane.

15 Claims, 2 Drawing Sheets

(56) References Cited

U.S. PATENT DOCUMENTS

| | | | | |
|---|---|---|---|---|
| 6,416,285 | B1 | 7/2002 | Fichter | |
| 2001/0022023 | A1* | 9/2001 | Wallis | B21D 26/055<br>29/889.72 |
| 2002/0028138 | A1* | 3/2002 | Lee | F04D 29/023<br>415/206 |
| 2004/0244403 | A1* | 12/2004 | Kim | F04D 17/165<br>62/419 |
| 2007/0098556 | A1* | 5/2007 | Sanagi | F04D 29/282<br>416/182 |
| 2018/0030994 | A1* | 2/2018 | Gebert | F04D 29/441 |

FOREIGN PATENT DOCUMENTS

| | | | | |
|---|---|---|---|---|
| JP | 2007-120445 | A | 5/2007 | |
| WO | WO-2017126444 | A1 * | 7/2017 | F04D 29/281 |

* cited by examiner

FAN WHEEL DISC AND FAN WHEEL

CROSS-REFERENCE TO RELATED APPLICATIONS

This application is a continuation of International Application No. PCT/EP2017/065463, filed Jun. 22, 2017, which claims priority to German Application No. 10 2016 111 830.3, filed Jun. 28, 2016. The disclosures of the above applications are incorporating herein by reference.

FIELD

The disclosure relates to a fan wheel disc and to a fan wheel having a corresponding fan wheel disc.

BACKGROUND

Fan wheel discs are used as bottom or cover discs in fan wheels for blowers. Application examples include radial fan wheels or diagonal fan wheels. Here, a distinction is made between single-part fan wheels, i.e., fan wheels made of one part, and multi-part fan wheels, i.e., fan wheels composed of several parts.

The published prior art is disclosed, for example, in the documents DE 20 2015 105 729 U1 or DE 20 2011 052 411 U1.

In multi-part fan wheels, the fan wheel blades are connected, usually welded, to the bottom and/or cover disc. For this purpose, the fan wheel blades are brought into a shape on their respective axial end edges, that corresponds to the shape of the fan wheel disc. Since the fan wheel discs in most cases have, from radially inside to radially outside, differently curved and/or spherical sections, the axial end edges have to be trimmed by means of in some cases complex three-dimensional cutting guides. Thus, the axial end edges can be brought fully in position on the fan wheel blade and be fastened. Such cutting guides for trimming the fan wheel blades are in fact technically possible, for example, by laser cutting, but are time consuming and costly. They are unsuitable for mass production.

Therefore, the underlying aim of the disclosure is to provide a fan wheel disc and a fan wheel that are designed, in such a manner, that it is possible to dispense with three-dimensional cuts for trimming the fan wheel blades and their adaptation to three-dimensionally curved regions of the fan wheel disc.

SUMMARY

This aim is achieved by the combination of features according to a fan wheel disc with at least one region that extends in a curved manner, at least in some sections, from radially inside to radially outside. A blade attachment surface, on the at least one region, fixedly connects an axial end side of at least one fan wheel blade. The blade attachment surface is formed at least in some sections. The blade attachment surface extends, at least in some sections, within the curved region of the fan wheel disc within a two-dimensional connecting plane (E).

According to the disclosure, a fan wheel disc has at least one region that extends in a curved manner at least in some sections from radially inside to radially outside. A blade attachment surface is formed, at least in some sections, for fixedly connecting an axial end side of at least one fan wheel blade. The blade attachment surface extends, at least in some sections, within the curved region of the fan wheel disc within a two-dimensional connecting plane.

The connecting plane is unequivocally pinned down to one plane beforehand and corresponds to a predefined plane in space. As a result of the blade attachment surface extending exclusively within one plane, the axial end edges of the fan wheel blades, to likewise be fastened, have to be trimmed only along this one connecting plane and thus not in a three-dimensionally curved or spherical manner. By means of a straight cut along the axial end edges of the fan wheel blades in this one predefined plane, the end edges can be brought to a shape that matches the fan wheel disc or the attachment surfaces of the fan wheel disc. The axial end edges of the fan wheel blades therefore have the same course as each of the attachment surfaces of the fan wheel disc. Thus, they can be set and fastened, for example, welded, on the attachment surfaces without additional processing steps. In an embodiment, in a circumferential direction, a plurality of corresponding attachment surfaces for a corresponding number of fan wheel blades is provided. The adaptation of the fan wheel disc in the present shape simplifies and accelerates the production of a fan wheel having a complex three-dimensional component geometry.

In an advantageous embodiment variant, the fan wheel disc is plastically deformed, at least in some sections, along the at least one blade attachment surface. The plastic deformation enables an adaptability of the fan wheel disc geometry precisely in the region of the connection of the fan wheel blades, without influencing the remaining regions in terms of flow.

Here, in a development, the at least one blade attachment surface of the fan wheel disc is formed in a press-in section that is pressed by plastic deformation in axial direction into the fan wheel disc. The direction along the rotation axis of the fan wheel disc is here defined as axial direction. Furthermore, via the press-in section, different axial press-in depths can be implemented, in order to design the three-dimensional extension of the attachment surfaces within the one connecting plane, even if the fan wheel disc geometry has extensive three-dimensional curvatures viewed in cross section. This means that the extension of the disc body of the fan wheel disc can extend in other planes and particularly in a curved manner, whereas the blade attachment surface extends exclusively in the connecting plane.

In an embodiment example, the press-in section has a deformation section that is plastically deformed in an axial direction, axially protrudes with respect to a disc surface and extends along the connecting plane. This means that, for generating the blade attachment surfaces, the plastic deformation of the fan wheel disc is sufficiently great. Thus, the deformation sections emerge on an axial side of the fan wheel disc, that lies opposite the side where the fan wheel blades are arranged. The formation of a protruding deformation section broadens the geometric adaptability of the blade attachment surfaces of the fan wheel disc. Thus, an extension within the one connecting plane can be implemented, even if the curvature of the disc body of the fan wheel disc is greatly or irregularly curved in the region of the disc attachment surfaces. The course of the press-in section is adapted, via the deformation section, so that the attachment surfaces extend along the one blade connecting plane for the end edges of the fan wheel blades independently of the extension of the adjacent disc surface body.

The shape of the deformation section, that protrudes axially and thus directly influences the flow, is also adaptable. Thus, in a design, the deformation section has an inlet section for the flow viewed in a circumferential direction, that forms a rounded off leading edge.

In a development, the deformation section has a variable width along its extension in a circumferential direction. In particular, an advantageous design is one where the deformation section, in an axial top view, has a substantially oval shape or a cross-sectional shape of a support surface profile. The latter is also an example of the included embodiment variant where the width of the deformation section advantageously decreases in terms of flow in an outlet section along its extension in the circumferential direction.

The fan wheel disc according to the disclosure can be used in general as a bottom disc or cover disc of a fan wheel. The bottom discs usually have a large-surface horizontally flat section, where there is no problematic three-dimensionally curved geometry. However, the cover discs are often greatly curved from radially inside to radially outside. Such a curvature exists in the case of a fan wheel disc converging funnel-shaped toward the rotation axis, that represents an embodiment example of the disclosure.

Part of the disclosure is a fan wheel having a multi-part design, that includes at least one fan wheel disc with has any feature combination of the above-described features.

The fan wheel usually includes a plurality, but in any case at least one fan wheel blade with a first and a second axial end edge. In an advantageous solution, one of the axial end edges has a shape corresponding to the press-in section of the fan wheel disc. A corresponding shaping can also be provided in general on both a cover disc and a bottom disc. The press-in sections are formed on both corresponding discs and end edges of the fan wheel blades. The disclosure is then applied on both the cover disc and the bottom disc. In such a case, the trimming of the fan wheel blades occurs on the two axial end edges in each case in a plane.

In the fan wheel it is advantageously provided that at least one of the axial end edges of the at least one fan wheel blade extends entirely along the connecting plane. Thereby, it is ensured that the end edge matches the blade attachment surface that fits on the fan wheel blade and is in full contact therewith. The fan wheel blades are thus cut or trimmed along their end edge so that they are geometrically adapted to the respective blade attachment surface of the fan wheel disc. The end edge surface and blade attachment surface extend in the same plane.

In a development, the end edge of the at least one fan wheel blade, which faces the fan wheel disc, extends entirely within the press-in section of the fan wheel disc. The end edge lies on the axial side on the blade attachment surface. The blade attachment surface is here determined by the axial bottom surface of the press-in section. Via the axial depth of the press-in section, and its related course, a geometric adaptation of the blade attachment surface to the end edge of the fan wheel blade in one and the same plane is also possible.

Furthermore, in a variant, the axial end edge of the at least one fan wheel blade is designed in a curved manner in an axial top view. Intrinsically curved fan wheel blades can be converted without problem, since their end edges are not only cut along a line but also along a fixed plane. The shaping of the attachment surfaces, press-in sections and/or deformation sections is then preferably of a correspondingly curved shape.

Other advantageous developments of the disclosure are characterized in the dependent claims and represented in greater detail below together with the description of the preferred design of the disclosure in reference to the figures.

DRAWINGS

The drawings described herein are for illustrative purposes only of selected embodiments and not all possible implementations, and are not intended to limit the scope of the present disclosure.

DETAILED DESCRIPTION

Figure 1:
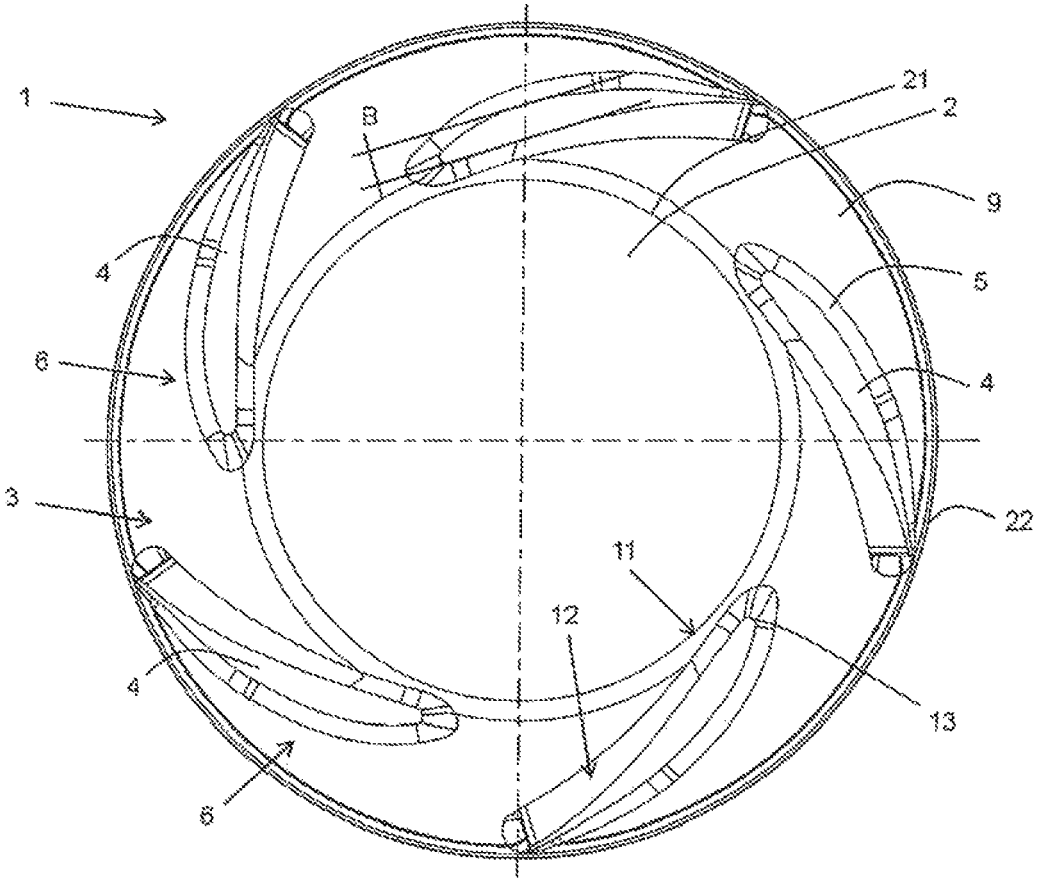
FIG. 1 is a plan view from below onto a fan wheel disc.

The figures show an exemplary embodiment of the disclosure, wherein identical reference numerals designate identical parts in all the views.

Figure 2:
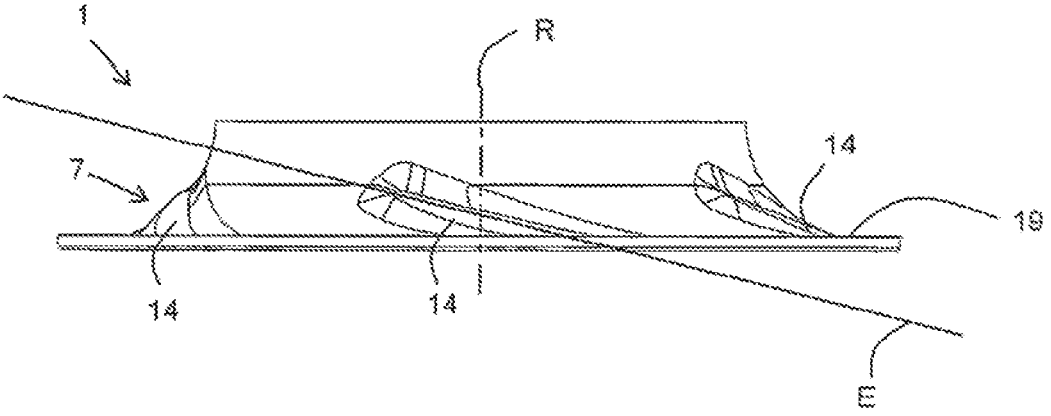
FIG. 2 is a side elevation view of the fan wheel disc from FIG. 1.

In FIGS. 1 and 2, a fan wheel disc 1, designed as a cover disc, is represented in a view from below and represented in a side view. In the central region lying around the rotation axis R, the fan wheel disc 1 has a flow opening 2. The disc body of the fan wheel disc 1 is funnel shaped. It has a region 3 that determines the funnel shape and extends in a curved manner from radially inside to radially outside. The disc body transitions from an extension on the radial circumferential edge 22, that corresponds substantially to a radial plane, to an extension on the flow opening edge 21, that corresponds substantially to an axial plane. In this curved region 3, a plurality of blade attachment surfaces 4, spaced apart in the circumferential direction is formed. Axial end sides of the fan wheel blades are attached to the blade attachment surfaces 4, as shown in an example in FIGS. 3 and 4. Each of the blade attachment surfaces 4 extends over its respective entire length from radially inside to radially outside along the fixed connecting plane E.

Each blade attachment surface 4 is formed in a press-in section 6 that is plastically deformed into the disc surface 9. In each case, on the axial bottom surface of the respective press-in section 6. The plastic deformation of the press-in section 6 passes through the entire disc body and, on the axially opposite side of the disc surface 9, it forms in each case an axially protruding deformation section 7, extending in each case along the connecting plane E, as can be seen in FIG. 2. The outer surfaces 14 axially opposite the disc attachment surfaces 4 extend parallel to the disc attachment surfaces 4. Due to the plastic deformation, the deformation sections 7 in each case form side walls 5 that protrude axially with respect to the disc body and the slope and shape of which can be adapted in terms of flow. In the design shown, the disc attachment surfaces 4 extend from radially inside to radially outside and in the circumferential direction over an angle of more than 30°. The press-in sections 5 extend from the radial circumferential edge 22 to a radially inside region of the fan wheel disc 1, in which its course transitions to an exclusively axial extension. In an axial top view, the disc attachment surfaces 4 in each case are in the shape of a support surface profile having a maximum width B. The disc attachment surfaces 4 taper from the maximum width B in the two flow directions. For this purpose, the deformation sections 7, in each case, have an inlet section 11 with a rounded off leading edge 13 and an outlet section 12 that converges essentially to a tip.

Figure 3:
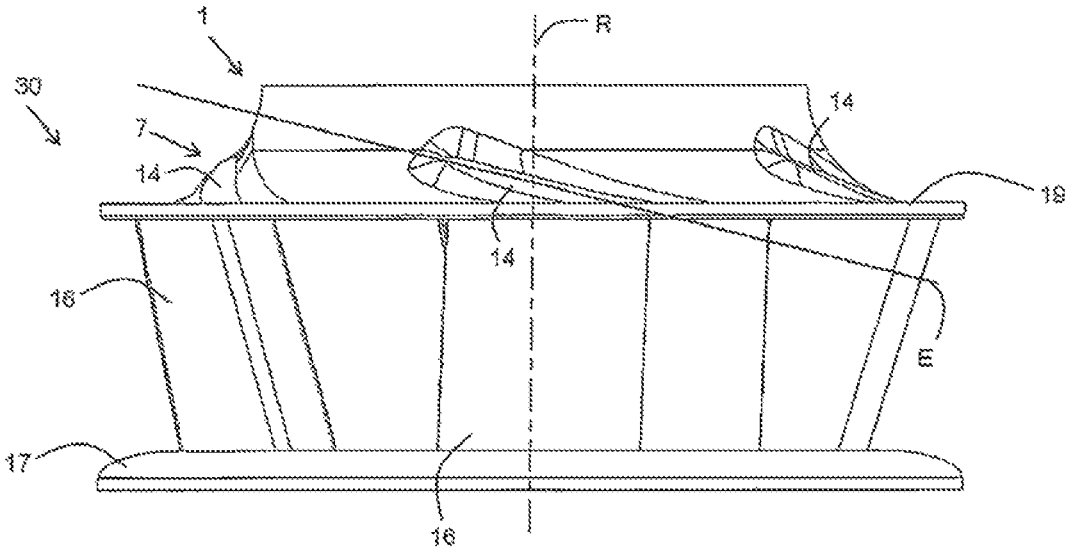
FIG. 3 is a side elevation view of a fan wheel with a fan wheel disc according to FIGS. 1 and 2.

In FIG. 3, a fan wheel 30 with a fan wheel disc 1 according to FIGS. 1 and 2 is represented in a side elevation view. The fan wheel 30 has a plurality of fan wheel blades 16 spaced apart in the circumferential direction. The fan wheel blades 16 are attached with their respective lower axial end edge to the bottom disc 17 and with their respective upper axial end edge to the fan wheel disc 1, designed as a cover disc. The upper axial end edges extend fully applied on the disc attachment surfaces 4 within the press-in sections 6 and thus along the connecting plane E. The fan wheel blades 16 here pass with their axial end edges through the disc body of the fan wheel disc 1 and are enclosed by the deformation section 7. The upper end edge surfaces of the fan wheel blades 16 have a shape corresponding to the disc attachment surfaces 4. Thus, in that regard, reference is made to the shape of the disc attachment surfaces 4 in FIG. 1. Here, the intrinsically curved shape of each of the fan wheel blades 16 can also be seen. The fan wheel blades 16 are spaced apart radially inward with respect to a radial circumferential edge of the bottom disc 17. On the fan wheel disc 1, the fan wheel blades 16, like the disc attachment surfaces 4, extend to its radial circumferential edge 22 and are substantially flush in the embodiment example shown.

The present disclosure has been described with reference to the preferred embodiment. Obviously, modifications and alternations will occur to those of ordinary skill in the art upon reading and understanding the preceding detailed description. It is intended that the present disclosure be construed to include all such alternations and modifications insofar as they come within the scope of the appended claims or their equivalents.

What is claimed is:

1. A fan wheel disc having at least one region that extends in a curved manner at least in sections from radially inside to radially outside, comprising:

a blade attachment surface with a desired configuration for fixedly connecting an axial end side of at least one fan wheel blade having a corresponding configuration, the blade attachment surface is formed at least in sections;

the blade attachment surface extends, at least in sections continuously from radially inside to radially outside and in a circumferential direction, within the curved region of the fan wheel disc within a two-dimensional connecting plane (E).

2. The fan wheel disc according to claim 1, wherein the fan wheel disc is plastically deformed along the at least one blade attachment surface at least in sections.

3. The fan wheel disc according to claim 2, wherein the at least one blade attachment surface is formed in a press-in section that is pressed by plastic deformation in an axial direction into the fan wheel disc.

4. The fan wheel disc according to claim 3, wherein the press-in section comprises a deformation section that is plastically deformed in axial direction and protrudes axially with respect to a disc surface and which extends along the connecting plane (E).

5. The fan wheel disc according to claim 4, wherein, viewed in circumferential direction, the deformation section comprises an inlet section that forms a rounded off leading edge.

6. The fan wheel disc according to claim 4 wherein the deformation section has a variable width (B) along its extension in circumferential direction.

7. The fan wheel disc according to claim 6, wherein the width (B) of the deformation section decreases along its extension in a circumferential direction in an outlet section.

8. The fan wheel disc according to claim 1, wherein it is designed as bottom disc or cover disc of a fan wheel.

9. A fan wheel, having a multi-part design and including a fan wheel disc according to claim 1.

10. The fan wheel according to claim 9, wherein it comprises at least one fan wheel disc with a first and a second axial end edge, the first axial end edge has a shape corresponding to a press-in section of the fan wheel disc.

11. The fan wheel according to claim 10, wherein the first axial end edge of the at least one fan wheel disc extends entirely along the connecting plane (E).

12. The fan wheel according to claim 10, wherein the first axial end edge of the at least one fan wheel disc extends entirely within the press-in section of the fan wheel disc and is in contact with the blade attachment surface on the axial side.

13. The fan wheel according to claim 9, wherein the first axial end edge of the at least one fan wheel blade is designed in a curved manner in an axial top view.

14. The fan wheel according to claim 9, wherein the fan wheel disc is designed in a shape of a funnel.

15. The fan wheel according to claim 10, further comprising an additional fan wheel disc that is fastened to the second axial end edge of the at least one fan wheel blade.

* * * * *